United States Patent [19]

Miyabayashi et al.

[11] 4,316,171

[45] Feb. 16, 1982

[54] NON-LINEAR RESISTANCE ELEMENTS AND METHOD FOR MANUFACTURING SAME

[75] Inventors: Susumu Miyabayashi, Misatoshi; Takeyuki Kaji, Nikaho, both of Japan

[73] Assignee: TDK Electronics Co., Ltd., Tokyo, Japan

[21] Appl. No.: 117,817

[22] Filed: Feb. 1, 1980

[30] Foreign Application Priority Data

Feb. 9, 1979 [JP] Japan ..... 54-13869

[51] Int. Cl.[3] ..... H01C 7/10

[52] U.S. Cl. ..... 338/21; 338/309; 338/328

[58] Field of Search ..... 338/20, 21, 322, 328, 338/329, 309; 252/518–521; 361/127; 106/39.5, 39.8, 73.3

[56] References Cited

U.S. PATENT DOCUMENTS 2,501,322 3/1950 Ferguson et al. ..... 338/21
3,503,029 3/1970 Matsuoka ..... 338/21 X
3,611,073 10/1971 Hamamoto et al. ..... 338/20 X
3,953,375 4/1976 Nagano et al. ..... 338/21 X
4,097,834 6/1978 Mar et al. ..... 338/21

*Primary Examiner*—C. L. Albritton
*Attorney, Agent, or Firm*—wyatt, Gerber, Shoup, Scobey & Badie

[57] ABSTRACT

A novel non-linear resistance element or varistor element is provided by the invention. The body of the element is a ceramic sintered body mainly composed of titanium dioxide admixed with small amounts of oxides of niobium, tantalum and/or antimony and electrodes are provided with a metallic material. Different from the conventional varistor elements, the electrode is bonded to the sintered body with ohmic contact by the techniques of flame spraying or electroless plating depending on the kind of the metallic material for the electrode selected from silver, aluminum, nickel and the like. Further improvement is proposed to increase the bonding strength of lead wires on to the electrodes by soldering as accomplished by providing a layer of a material having good solder-receptivity on the electrode which also serves for preventing the oxidation of the electrode material.

8 Claims, 15 Drawing Figures

NON-LINEAR RESISTANCE ELEMENTS AND METHOD FOR MANUFACTURING SAME

BACKGROUND OF THE INVENTION

The present invention relates to a non-linear resistance element having a large voltage dependence of the electric resistance or, more particularly, to a so-called varistor element of titanium dioxide-based sintered body and a method for manufacturing same.

Non-linear resistance elements, for example, a ceramic varistor exhibits non-linear relationship between the value of the electric current across a sintered ceramic body and the voltage applied between the electrodes provided on the surfaces of the ceramic body and, accordingly, the value of the electric resistance of the body is not a constant value but drastically decreases in the region where the voltage applied to the electrodes exceeds certain threshold value called a varistor voltage. Utilizing this unusual property in an electric circuit, varistors have found wide applications, for example, for the noise suppression of small-sized DC motors used in or relating to acoustic instruments, protection of contacting points of relays, discharge absorption in Braun tube circuits of color television sets and the like.

Conventional materials for the prior art ceramic-based varistor elements are, for example, tin oxide $SnO_2$, iron oxide $Fe_2O_3$, silicon carbide SiC and the like. Sintered bodies of tin oxide or iron oxide are themselves linear resistor elements and the non-linearity necessary for a varistor element is obtained by forming a potential barrier between the surface of the sintered body and a specific electrode provided on the surface of the body. The electrodes for silicon carbide-based varistors are not limitative since the non-linearity of the element is warranted by the interfacial phenomenon in the grain boundaries of the silicon carbide.

Conventional ceramic varistors of the prior art, however, suffer from several defects or problems such as the undesirably high production cost due to the difficulties in manufacturing the sintered bodies and forming electrodes, deterioration of the non-linearity in the lapse of time and the relatively high varistor voltage unsuitable for noise suppression in small-sized DC motors driven at low voltages.

An improvement to overcome the above described drawbacks in the ceramic varistors of prior art has been proposed recently, according to which the sintered ceramic body is shaped with titanium dioxide as the main ingredient admixed with very small or trace amounts of bismuth oxide and an oxide of a semi-conductive element such antimony, niobium, tantalum and the like (see, for example, Japanese Patent Publication 52-235 and U.S. Pat. No. 3,715,701). Sintered bodies of this type exhibit themselves a non-linearity in the voltage-current relationship with considerably low varistor voltage so that they are suitable for low-voltage uses such as the noise suppression in small DC motors in so far as the non-linearity of the sintered body is the only matter concerned.

One of the problems in the titanium dioxide-based ceramic varistors is, however, in the manner of contacting between the sintered body and the electrode. In the varistor elements of prior art, the contact between the sintered body of titanium dioxide and the electrode is non-ohmic so that a phenomenon of rectification appears in the interface between them overlapping the non-linearity in the voltage-current relationship of the sintered body itself. Therefore, the performance of the varistor element is made less clear-cut and the excellent non-linear characteristics of the sintered body cannot be fully utilized.

SUMMARY OF THE INVENTION

It is therefore an object of the present invention to provide a novel and improved non-linear resistance element or varistor element free from the above described problems in the prior art varistor elements in which the excellent non-linear characteristics of titanium dioxide-based sintered ceramic bodies can be fully utilized to give a clear-cut performance of the varistor element.

The non-linear resistance element of the invention comprises a ceramic sintered body composed mainly of titanium dioxide and at least one electrode made of a metallic material and bonded to the surface of the ceramic sintered body in ohmic contact. As the metal suitable for making the electrode is proposed one or an alloy of metals such as silver, aluminum, zinc, tin, copper, lead, bismuth, nickel and the like.

The method for providing electrodes of above named metals depend on the particular kind of the metals so as to form ohmic contact with the surface of the titanium dioxide-based sintered ceramic body. Electrodes of most of the above named metals can be formed by the technique of flame spraying while nickel electrodes are most suitably formed by electroless plating to be imparted with ohmic contacting.

A further improvement is proposed in which a metallic layer having good solder receptivity is provided on the above described electrode since the surface of a metal formed by flame spraying or electroless plating as above has a rather poor solder receptivity for facilitating bonding of lead wires by soldering.

DETAILED DESCRIPTION OF THE PREFERRED EMBODIMENTS

Figure 1:
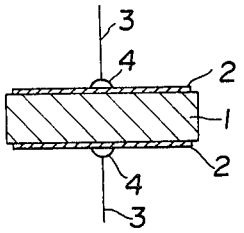
FIG. 1 is a cross sectional view of a typical varistor element.

A ceramic varistor element has typically a structure as shown in FIG. 1 by the cross section although actual forms are determined, of course, according to particular applications of the varistor elements. As is shown in FIG. 1, a sintered ceramic body 1 in a form of a disc is provided on both surfaces thereof with electrodes 2, 2 and lead wires 3, 3 are bonded to the electrodes 2, 2 by use of solder 4, 4.

Figure 2:
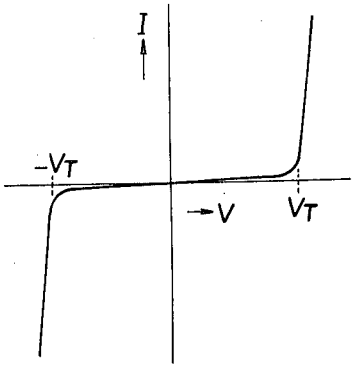
FIG. 2 is a graphic showing of typical voltage vs. current relationship in a varistor element.

FIG. 2 shows a voltage vs. current relationship in a varistor in which the current I increases non-linearly as the voltage V applied to the electrodes is increased and when the voltage V exceeds a certain critical value $V_T$, the current I increases rapidly corresponding to the decrease of the electric resistance.

Figure 3:
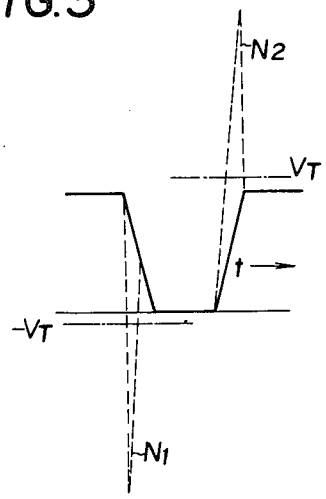
FIG. 3 is a graphic showing of the noise voltages in a DC motor as a function of time.

Usually, the widths of the commutator segments and the brushes in small-sized DC motors are small and the rate of change in the current through the armature coils is large with large reactance voltage so that sparks are very frequently produced between the surface of the commutator and the brush in the moment when the brush skips from a commutator segment to the next one. These sparks cause spike-like noise voltage and accelerate the wearing of the commutator and the brushes with consequently shortened life of the motor. This noise voltage is, as is shown in FIG. 3 as a function of time t, a bipolar voltage and has a peak value as large as several tens of times larger than the line voltage giving undesirable influences to the other instruments electrically connected to the motor. Varistor elements are used with an object to eliminate these noise voltages and the noise voltages $N_1$, $N_2$ are absorbed by short circuiting in the range where the noise voltages $N_1$ and $N_2$ exceed the varistor voltage $V_T$. It is desirable in this case that the varistor voltage $V_T$ is larger than the line voltage of the motor with a not so large difference so that the non-linear resistance elements as the varistor for preventing noise generation in small DC motors should have good varistor characteristics in the low voltage region.

Figure 4:
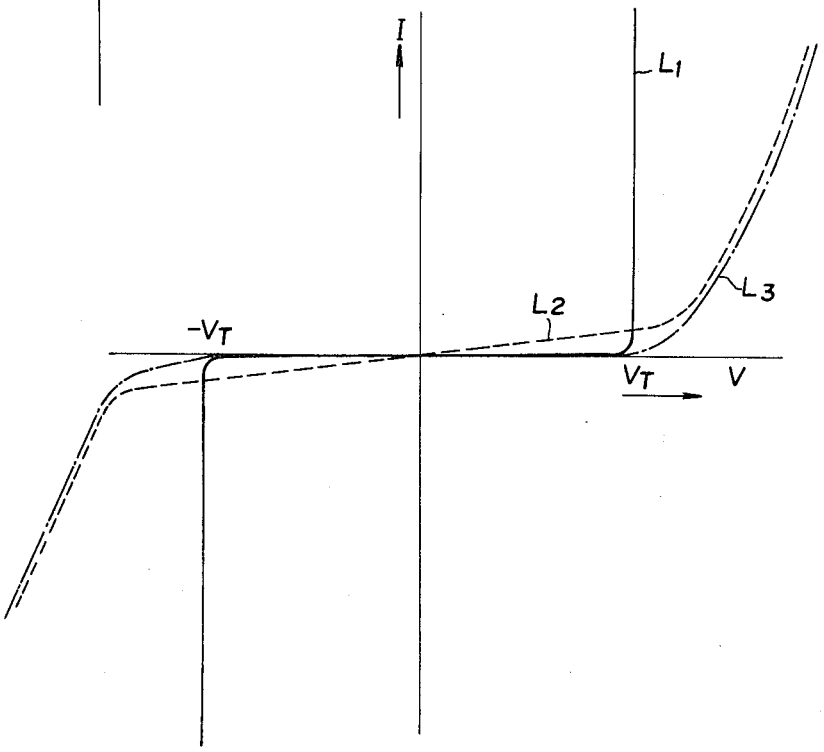
FIG. 4 is a schematic graphic showing illustrating the overlapping of the varistor characteristics in the body of a varistor element and the rectification characteristics in the interface between the varistor body and the electrode.

As is mentioned before, a titanium dioxide-based ceramic varistor has excellent varistor characteristics as is shown by the curve $L_1$ in FIG. 4 at least as the non-linearity of the sintered body is the only matter concerned. When the contact between the sintered body and the electrodes is nonohmic, a phenomenon of rectification is produced at the interface as is shown by the curve $L_2$ in FIG. 4 resulting in an overall voltage-current relationship as is shown by the curve $L_3$ as the summation of the curves $L_1$ and $L_2$, which is less satisfactory in respect of the varistor characteristics so that the excellent performance of the sintered body is greatly reduced.

Accordingly, the present invention established as a result of extensive investigations undertaken by the inventors proposes a non-linear resistance element which comprises a sintered ceramic body composed mainly of titanium dioxide and at least one electrode made of a metallic material and bonded to the surface of the ceramic sintered body in ohmic contact.

The ceramic sintered body above mentioned is prepared by sintering titanium dioxide admixed with small amounts of one or more of the oxides selected from the group consisting of niobium oxide, tantalum oxide and antimony oxide. The method for manufacturing such a sintered body is conventional and not described here in further detail. The forms and dimensions of the sintered body are also not limitative according to particular applications of the varistor element.

The electrode, which should be bonded to the surface of the ceramic sintered body in ohmic contact, is made of a metallic material. The metallic materials suitable for forming such an electrode in ohmic contact with the surface of the sintered body include aluminum, zinc, tin, silver, copper, lead, bismuth and nickel as well as alloys of these metals. Most preferred among the above named metals is silver but it should be noted that highly pure silver is not suitable for forming electrodes bonded to the sintered body in ohmic contact and the silver suitable for use should contain at least one auxiliary metallic element selected from the group consisting of indium, gallium, tin, antimony, cadmium, zinc and aluminum in an amount in the range from 2 to 20% by weight.

Various methods or techniques can be used for forming electrodes with the metallic material above mentioned on the surface of the sintered body in ohmic contact but it is important that particular metallic materials should be combined with particular methods for forming the electrode in order to have most complete ohmic contact between the electrode and the sintered body. For example, vacuum deposition may be suitable with several kinds of the metals when impractically high costs in the process is disregarded.

A less expensive method for forming silver electrodes on the sintered body is the use of a silver paste containing an auxiliary metallic element as mentioned above and a frit. Silver electrodes can readily be formed with such a silver paste by the techniques of, for example, screen printing followed by baking. This method of printing and baking is quite suitable for mass production of ceramic varistor elements with relatively low production costs.

Another method for forming good ohmic-contact electrodes is the so-called flame spraying with the metal. Flame spraying is a method in which the metallic material is continuously melted in a flame spraying machine where the molten metal is blown with a gas jet and sprayed in the form of fine molten droplets on to the substrate surface to form continuous metallic film thereon. This method of flame spraying can readily give electrodes of a metallic material with a purity as high as desired in good ohmic contact with the surface of the sintered body. What is more important, the varistor characteristics of the thus manufactured non-linear resistance elements are very uniform since the reproducibility of the electric properties, e.g. electric resistance, of the electrodes is very high.

In addition, the bonding strength of the metal electrode to the sintered body is very large when the electrode is formed by the method of flame spraying so that the electrodes can enjoy good durability without the danger of, for example, exfoliation resulting in a very high reliability of the varistor elements.

Metallic materials suitable for the flame spray procedure include aluminum, zinc, tin, silver, copper, lead and bismuth. These metallic materials can readily form electrode layers on the surface of the sintered body in good ohmic contact with inexpensiveness when compared with the indium-gallium alloys conventionally used as the electrode materials. Furthermore, the flame spraying procedure on to the titanium dioxide-based sintered body with these metallic elements is almost the same as in the formation of ohmic-contact electrodes on barium titanate-based ceramic semiconductors and the like.

In carrying out the method of flame spraying on to the surface of a ceramic sintered body, the sintered body is overlaid by a mask with an openwork corresponding to the desired pattern of the electrode and the molten metal is sprayed thereon to give the electrode of desired pattern.

Figure 5:
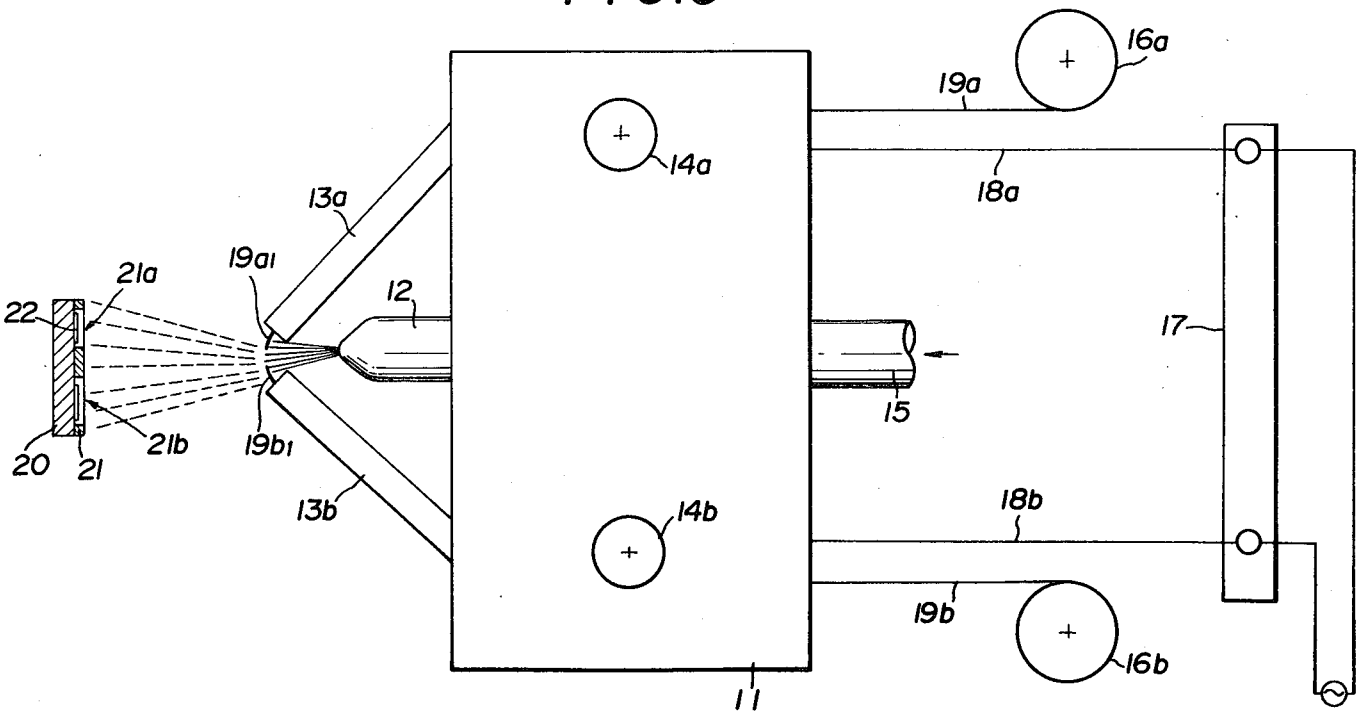
FIG. 5 is a schematic illustration of a flame spraying machine and a sintered body under flame spraying as mounted on the machine.

FIG. 5 illustrates a flame spraying machine and a sintered body under flame spraying covered with a mask and mounted on the machine. As is shown in the figure, the body 11 of the machine is equipped with a spray nozzle 12 and a pair of metal wire feeders 13*a*, 13*b* through which the metal wires 19*a*, 19*b* are supplied continuously into the spraying zone at the spraying end of the spray nozzle 12 as pulled out from the wire reels 16*a*, 16*b* and advanced by means of the feeder rollers 14*a*, 14*b*. Compressed air or a suitable gas is supplied into the air inlet 15 and blown out of the spraying nozzle 12 as a jet into the spraying zone. An AC or DC electric power is supplied to the metal wires, e.g. aluminum wires, 19*a*, 19*b* from the lines 18*a*, 18*b* supported by the line supporter 17. When the advancing ends $\mathbf{19}_{a1}$, $\mathbf{19}_{b1}$ of the metal wires 19*a*, 19*b* are contacted with each other and then pulled apart slightly, an electric arc is produced in the space between the advancing ends $\mathbf{19}_{a1}$, $\mathbf{19}_{b1}$ of the metal wires 19*a*, 19*b* so that the wires 19*a*, 19*b* are melted at the ends $\mathbf{19}_{a1}$, $\mathbf{19}_{b1}$. The thus molten metal in the spraying zone is immediately blown off by the jet coming from the spraying nozzle 12 and sprayed on to the surface of the sintered body 20 through the openworks 21*a*, 21*b* of the mask 21 to deposit metal layers 22 on the surface of the sintered body 20 forming the electrodes of desired pattern.

The above described flame spraying method through a mask with openworks is very advantageous since a mask having any complicated openworks can be prepared readily by machining, molding or other suitable means so that any complicated pattern of the electrodes can be reproduced easily with high accuracy and convenience. It may be too much to say that a uniform spray coating of the sintered body by flame spraying with a molten metallic material followed by the removal of the unnecessary portions of the metal layer can be carried out only with great difficulties and much labor leading to remarkably decreased productivity and increased production costs when the pattern of the desired electrodes is complicated.

The mask 21 with openworks 21*a*, 21*b* is removed from the surface of the sintered body 20 after completion of flame spraying and can be used repeatedly. Recommended materials of the mask 21 should be metals not adhesive with the molten metal sprayed thereon such as brass and desirably provided with a layer of a releasing agent such as a carbonaceous material or ethyleneglycol before use so as to facilitate peeling and removal of the metal layer deposited thereon in the flame spraying without forcible peeling which may lead to shortened life of the mask due to the deformation of the mask configuration.

The sintered body provided with the electrode by the flame spraying method as described above is preferably subjected to an aging treatment at a temperature of 100° to 300° C. for 30 to 180 minutes so as to improve the stability of the ohmic contact between the sintered body and the electrode.

Figure 6A:
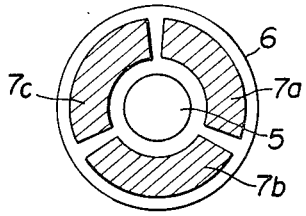
FIG. 6(*a*) and FIG. 6(*b*) are plan views of the top surface and the bottom surface, respectively, of an annular sintered body for use as a noise suppresser in DC motors provided with sector-wise or ring-wise electrodes.
Figure 6B:
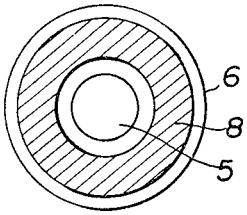

Particular patterns of the electrodes provided on the surface of the sintered body naturally depend on the particular applications of the varistor elements with the electrodes. One of the typical pattern of the electrodes in a varistor element used for the noise suppression in small-sized DC motors is shown in FIG. 6(*a*) and FIG. 6(*b*) for each of the opposite surfaces of a sintered body, respectively. The sintered body 6 is provided with a circular hole 5 at the center through which the rotating shaft of the motor is to be inserted. Thus, the sintered body 6 as a whole has an annular configuration. In one surface of the sintered body 6 shown in FIG. 6(*a*) are provided three electrodes 7*a*, 7*b*, 7*c* in equally divided sectors. On the opposite surface of the same sintered body 6 is provided a single annular electrode 8 as is shown in FIG. 6(*b*). These electrodes are formed, for example, by the method of flame spraying is described above.

Figure 7:
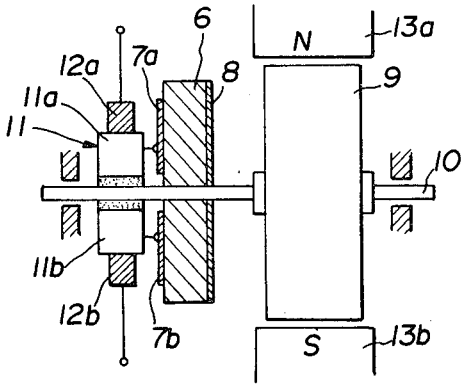
FIG. 7 is a schematic cross sectional view of a DC motor provided with a varistor element as mounted on the shaft of the rotor.

FIG. 7 is a cross sectional illustration of a small-sized DC motor with a varistor element as shown in FIG. 6(*a*) and FIG. 6(*b*) built therein. The varistor element composed of the sintered body 6 and the electrodes 7*a*, 7*b*, 7*c* and 8 on both surfaces is mounted on the shaft 10 of the rotor having an armature coil 9 and a commutator 11 integrally mounted on the shaft 10 to be rotatable in the magnetic field formed by the field magnets 13*a*, 13*b*. The position of the varistor element is between the armature coil 9 and the commutator 11 on the shaft 10. Each of the ohmic-contact electrodes 7*a*, 7*b*, 7*c* electrically connected to one of the commutator segments 11*a*, 11*b*, 11*c* coming into intermittent contact with the brushes 12*a*, 12*b* as the rotor rotates.

In this mounting and connection of the varistor element in the DC motor, the varistor characteristics of the element are exhibited in the portions of the sintered body 6 between each of the ohmic-contact electrodes 7*a*, 7*b*, 7*c* and the common electrode 8 on the opposite surface. This means that the varistor element is built in the motor to form a star connection as is shown in the equivalent circuit given in FIG. 8 according to which three non-linear resistance elements $P_a$, $P_b$, $P_c$ are connected star-wise with the electrode 8 as the neutral point with respect to the three armature coils 9*a*, 9*b*, 9*c*. When noise voltages $N_1$, $N_2$ as shown in FIG. 3 are produced in the motor with this varistor connection, varistor effect to absorb the noise voltage is obtained in at least two of the three equivalent non-linear resistance elements $P_a$, $P_b$, $P_c$ so that the noise voltages $N_1$, $N_2$ are effectively absorbed in the commutator with no adverse influences to the outer circuits.

Figure 8:
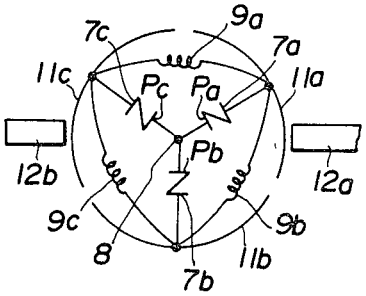
FIG. 8 is an equivalent circuit of the motor rotor with a varistor element in star connection.
Figure 9:
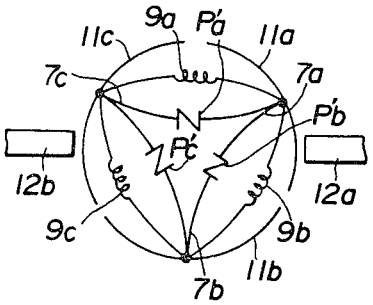
FIG. 9 is an equivalent circuit of the motor rotor with a varistor element in delta connection.

In contrast to the star connection shown in the equivalent circuit given in FIG. 8, a delta connection can also be formed as is shown by the equivalent circuit given in FIG. 9. In this case, the varistor element to be used has three sector electrodes 7*a*, 7*b*, 7*c* as shown in FIG. 6(*a*) on one surface of the sintered body 6 but no electrode is provided on the opposite surface. As is shown in FIG. 9, three equivalent non-linear resistance elements $P_a'$, $P_b'$, $P_c'$ formed between two of the electrodes 7a, 7b, 7c are connected in delta each through one of the commutator segments 11a, 11b, 11c. This delta connection is also effective in noise suppression by the varistor effect exhibited by three non-linear resistance elements $P_a'$, $P_b'$, $P_c'$. Meanwhile, the armature coils 9a, 9b, 9c in FIG. 8 and FIG. 9 are in delta connection but they can of course be connected in star according to need.

It is pointed out also that the number of the sector electrodes is determined according to the number of the commutator segments although the above description has been given assuming three commutator segments.

Among the methods for obtaining ohmic contact between the electrode of a metallic material and the surface of the sintered body, the method of flame spraying is applicable to most of the metallic materials. The method of flame spraying is, however, not almighty for all kinds of metallic materials. For example, the contact between an electrode of nickel formed by flame spraying and the surface of a sintered body of titanium dioxide is not so good ohmic contact.

Accordingly, the inventors have conducted extensive investigations to develop a method for obtaining an nickel electrode which is in good ohmic contact with the surface of a titanium dioxide sintered body and arrived at a conclusion that good ohmic contact of a nickel electrode is obtained when the nickel electrode is formed by electroless plating on the surface of the sintered body.

The procedure for the electroless plating of nickel on the surface of a sintered body is as follows. Firstly, a sintered body, which is in any desired form according to the intended application such as the annular one shown in FIG. 6, is provided with a layer of a plating resist on the surface covering the portions where no nickel layer should be deposited by the electroless plating leaving the areas of the electrodes exposed bare so as to define the electrode pattern. The layer of the plating resist can be formed by a suitable method such as screen printing. As the material for the plating resist are used various kinds of organic polymeric substances insoluble in the undermentioned plating solutions.

In the next place, the sintered body thus provided with the layer of the plating resist is activated on the exposed areas for electrode formation by dipping in an aqueous solution of tin chloride and palladium chloride (see, for example, Journal of the Electrochemical Society, vol. 107, p. 250, 1960) followed by the electroless plating in a plating solution containing nickel chloride, sodium hypophosphite and sodium citrate at a temperature of 80° to 90° C. to deposit a layer of nickel containing phosphorus. Thereafter, the layer of the plating resist is removed away by dissolving with a suitable organic solvent. If necessary, the layer of nickel-phosphorus deposited on undesired areas is removed by a suitable mechanical means such as centerless grinding or sand blasting to leave the electrodes in an exact desired pattern.

It is important that the ohmic contact between the nickel electrode formed by electroless plating and the surface of the sintered body is more complete when the electrode is composed of 98 to 80% by weight of nickel and 2 to 20% by weight of phosphorus. The weight ratio of nickel and phosphorus in the deposited layer is controlled by adjusting the pH value of the plating solution which should be in the range from 2 to 10 since a higher value of the pH than 10 results in a smaller content of phosphorus than 2% by weight while a lower value of pH than 2 results in a higher content of phosphorus than 20% by weight.

The sintered body provided with the nickel-phosphorus electrodes as described above is then preferably subjected to aging treatment by heating at about 300° C. to stabilize the ohmic contacting condition of the electrodes with the surface of the sintered body.

An alternative way for forming pattern-wise electrodes on the surface of the sintered body is the use of an etching resist. In this case, the sintered body is first provided with the desposition of the nickel-phosphorus all over the surface by the electroless plating. Then the areas corresponding to the desired electrode pattern are coated with an etching resist which is a material resistant to the etching solution as mentioned below by screen printing or other suitable methods. The next step is dipping of the sintered body in an etching solution so as that the nickel-phosphorus layer on the areas uncoated with the etching resist is removed by being dissolved in the etching solution. An example of the etching solution is a mixtrue of acetic acid, nitric acid and acetone in a ratio of 1:1:1 which is used at a temperature of about 40° C. Finally, the etching resist covering the electrode areas is removed by washing with an alkaline solution or an organic solvent according to the nature of the etching resist material used. The heat treatment for aging is undertaken also in this case in the same manner as in the use of the plating resist.

At any rate, the method of electroless plating for forming nickel-phosphorus electrodes is very advantageous because the adhesion of the electrodes to the surface of the sintered body is very strong and the contact is excellently ohmic even by setting aside the remarkably reduced costs for electrode formation. In addition, electrodes of any complicated pattern can readily be formed with high exactness since the pattern formation is undertaken by the techniques of screen printing or other printing methods with the plating resist or the etching resist and the removal of the resist materials can be performed by dissolving without mechanical means so that no danger is encountered to injure the surface of the sintered body per se in the course of the pattern formation.

The next step for the manufacture of a varistor element is bonding of lead wires to each of the electrodes by soldering as is shown in FIG. 1. A problem to be taken into consideration in this case is the solder receptivity of the electrode surfaces. For example, aluminum or nickel electrodes are poorly solder receptive regardless of the method for the formation of the electrodes by the reason of the oxide film formation on the surface or other reasons. Therefore strong bonding of lead wires to the electrodes of these metallic materials can hardly be obtained by soldering. In addition, oxidation of the electrode material may sometimes adversely affect the ohmic contact between the electrode and the surface of the sintered body resulting in decreased reliability of the varistor characteristics in a long run use of the varistor element. Further, an electrode of silver formed by the method of flame spraying is also poorly solder receptive. This poor solder receptivity is more apparent when the electrode is formed of a silver material admixed with small amounts of the auxiliary elements such as indium, gallium, antimony, cadmium, zinc, aluminum and the like as mentioned before than the electrode of high purity silver.

The above mentioned difficulties in soldering can be overcome by providing a layer of a metallic material having good solder receptivity on to the electrode formed on the sintered body.

Figure 10:
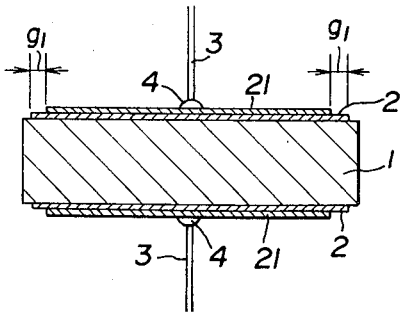
FIG. 10 is a cross sectional view of the varistor element provided with the solder-receptive layers on the electrodes.

An example of varistor elements provided with such a solder receptive layer on each of the surfaces to cover the electrodes is shown in FIG. 10 by the cross section. The sintered body 1 is a disc similar to that given in FIG. 1 and is provided on each of the opposite surfaces with the electrodes 2, 2 formed by a suitable method such as printing with a silver paste, flame spraying with molten aluminum or electroless plating of nickel-phosphorus. Covering the electrodes 2, 2 are provided solder-receptive metallic layers 21, 21 to which the lead wires 3, 3 are bonded with solder 4, 4.

The method for forming the solder-receptive layer is not limitative. For example, the layers are formed most conveniently by printing, e.g. screen printing, with a silver paste containing high purity silver particles dispersed therein. It is important in carrying out the printing with the silver paste that the silver paste never spread on to the areas where the electrode layer is not formed by misplaced printing. A recommendable way for avoiding such a misplaced printing is to design the printed pattern not to cover all over the electrodes 2 but the printed pattern of the solder-receptive layer 21 is somewhat smaller than the electrodes 2 leaving marginal gaps $g_1$ around the periphery of the electrodes 2, 2.

Several advantages are obtained by this technique of providing solder-receptive layers on the electrodes not only in the very much improved bonding strength of lead wires by soldering but also in the increased durability of the varistor element owing to the prevention of oxidation of the electrode material by the solder-receptive layers covering almost all of the electrode surfaces resulting in the preservation of the ohmic contact between the electrode and the surface of the sintered body over a long period of time.

The solder-receptive metallic layers can be formed also by the electrolytic plating of tin or other suitable metals or plating with a solder alloy. One of the advantages of this electrolytic plating over the printing method with a silver paste is that the metallic plating is obtained all over the surfaces of the electrodes without the danger of overspreading of the solder-receptive layers to the undesired areas so that the solder-receptive areas of the electrodes are greatly increased and the prevention of electrode oxidation is more complete.

Figure 11:
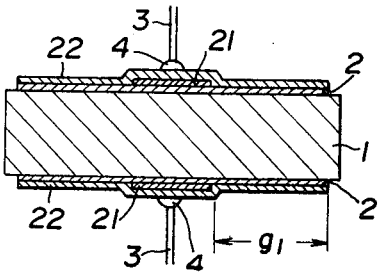
FIG. 11 is a cross sectional view of the varistor element provided with the dual solder-receptive layers on the electrodes.

FIG. 11 is a cross sectional view of a varistor element, in which the sintered body 1 is first provided with ohmic-contact electrodes 2, 2 on both of the opposite surfaces and then solder-receptive layers 21, 21 are formed on the electrode surfaces by printing with a silver paste leaving marginal gaps $g_1$ around the solder-receptive layers 21, 21. Next, second solder-receptive layers 22, 22 are formed by the electrolytic plating of, for example, tin to cover whole areas of the first solder-receptive layers 21, 21 and the surfaces of the electrodes 2, 2 not covered by the first solder-receptive layers 21, 21. An advantage of such a double-layer coating is the further improved prevention of the electrode oxidation along with the increased solder-receptive areas.

Figure 12A:
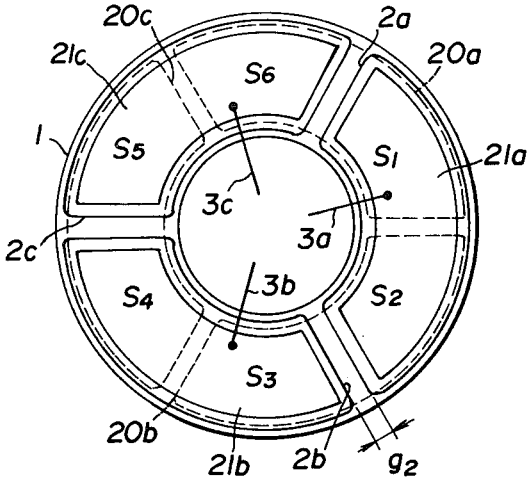
FIG. 12(*a*) and FIG. 12(*b*) are plan views of the top surface and the bottom surface, respectively, of an annular varistor element having three sector-wise electrodes on each of the surfaces, the electrodes on the top surface being covered with the solder-receptive layers.
Figure 12B:
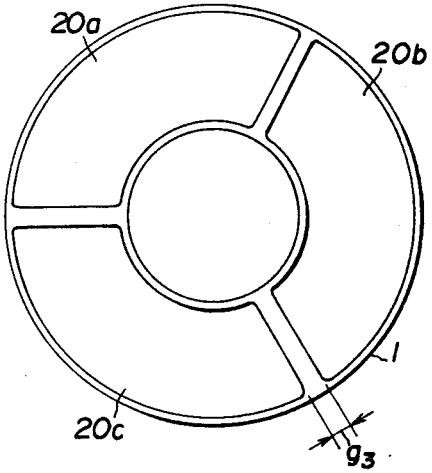

FIG. 12(*a*) and FIG. 12(*b*) are plan views of the top surface and the bottom surface, respectively, of an annular varistor element similar to that shown in FIG. 6 used for the noise suppression in small-sized DC motors. As is shown in FIG. 12(*a*), the sintered body 1 is provided on the top surface with three sector-wise electrodes 2*a*, 2*b*, 2*c* in ohmic contact with the surface of the sintered body 1 as formed by a suitable method such as flame spraying with a molten metal. Each of the electrodes 2*a*, 2*b*, and 2*c* has equal area with a span of somewhat smaller than 120° to the center, gaps $g_2$ being provided between the adjacent electrodes. Each of the electrodes 2*a*, 2*b*, 2*c* is covered with the respective solder-receptive layer 21*a*, 21*b* or 21*c* formed by printing with a silver paste or by electrolytic plating of tin as is described above, the dimension of the solder-receptive area 21*a*, 21*b* or 21*c* being somewhat smaller than the respective electrode 2*a*, 2*b* or 2*c* with marginal uncovered areas. Three lead wires 3*a*, 3*b*, 3*c* are bonded on to the solder-receptive layers 21*a*, 21*b*, 21*c*, respectively, with solder.

On the other hand, the bottom surface of the sintered body 1 is provided, as is shown in FIG. 12(*b*), with three similar sector-wise electrodes 20*a*, 20*b*, 20*c* with gaps $g_3$. These electrodes 20*a*, 20*b*, 20*c* on the bottom surface are also shown in FIG. 12(*a*) by the broken lines. As is shown in FIG. 12(*a*), the radial disposition of these electrodes 20*a*, 20*b*, 20*c* on the bottom surface is not in direct back-to-face correspondence to the electrodes 2*a*, 2*b*, 2*c* on the top surface but each of the electrodes is positioned at the angular position rotated by 120° from the position in direct back-to-face correspondence to one of the electrodes on the opposite surface. Thus, the sintered body 1 has six varistic regions $S_1$, $S_2$, $S_3$, $S_4$, $S_5$ and $S_6$ each sandwiched between two opposite electrodes 2*a*–20*a*, 2*a*–20*b*, 2*b*–20*c*, 2*c*–20*c* or 2*c*–20*a*, respectively. Meanwhile, the electrodes 20*a*, 20*b*, 20*c* on the bottom surface are not covered with the solder-receptive layers since no lead wires are bonded to these electrodes by soldering.

Figure 13:
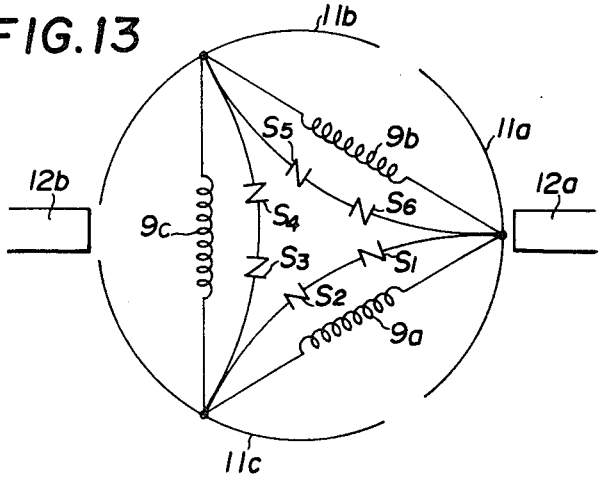
FIG. 13 is an equivalent circuit of the rotor of a DC motor with the varistor element of FIG. 12.

The mounting of the above described varistor element having three sector electrodes on each of the opposite surfaces is just the same as in the varistor element shown in FIG. 6 as illustrated in FIG. 7. The equivalent circuit involving the armature coils 9*a*, 9*b*, 9*c* and the commutator segments 11*a*, 11*b*, 11*c* in this case is as shown in FIG. 13. In this equivalent circuit, a combination in series of two of the six varistic regions $S_1$ to $S_6$ is connected in delta connection to one of the armature coils 9*a*, 9*b*, 9*c* also in delta connection through one of the commutator segments 11*a*, 11*b*, 11*c*. Therefore, the effect of noise absorption is obtained in all of the varistic regions $S_1$ to $S_6$ when a noise voltage is produced so that excellent noise suppressing effect is obtained even in large current ranges.

Following is a summary of the advantages obtained by the inventive non-linear resistance elements as described above.

(1) The varistor characteristics possessed by the sintered body per se can be fully exhibited with low varistor voltages so that non-linear resistance elements as a very effective noise suppresser is obtained for small-sized DC motors driven at low voltages.

(2) The bonding strength between the surface of the sintered body and the ohmic-contact electrode is very strong without the danger of eventual exfoliation of the electrodes so that the varistor elements obtained in the invention have very high reliability even in a prolonged service.

(3) Deterioration of the varistor characteristics is very small in the lapse of time along with the excellent anti-corrosiveness of the electrodes contributing to the durability of the varistor elements.

(4) The materials for the electrodes and the solder-receptive layers are inexpensive and the process for the manufacture of the inventive varistor elements is also not so complicated so that the varistor elements can be manufactured with low cost and high productivity in a mass production.

(5) The purity of the metallic materials for the ohmic-contact electrodes can be controlled according to need so that good reproducibility is obtained in the quality of the varistor elements.

(6) The exactness of the electrode configuration is ensured by the use of masks in flame spraying or by the use of plating resist or etching resist in the plating process so that the dimensional accuracy of the products is high.

(7) The bonding strength of the lead wires is very high owing to the presence of the solder-receptive layers, which contributes to the simplification of the assembling works of the varistor elements along with the dimensional accuracy mentioned above.

What is claimed is:

1. A non-linear resistance element which comprises (a) a sintered body mainly composed of titanium dioxide, (b) at least one electrode made of a metallic material and bonded to the surface of the sintered body forming ohmic contact therewith, (c) a layer of a first solder-receptive metallic material covering at least part of the outer surface of the electrode, and (d) a layer of a second solder-receptive metallic material covering the layer of the first solder-receptive material and the surface of the electrode not covered by the layer of the first solder-receptive material.

2. The non-linear resistance element as claimed in claim 1 wherein the layer of the first solder-receptive metallic material is formed by printing with a silver paste containing silver of high purity and the layer of the second solder-receptive metallic material is formed of tin by electrolytic plating.

3. A non-linear resistance element which comprises:

(a) a sintered body principally containing titanium dioxide;

(b) at least one electrode comprising silver containing from 2 to 20% by weight of at least one auxiliary element selected from the group consisting of indium, gallium, tin antimony, cadmium, zinc and aluminum.

4. A non-linear resistance element of claim 3 wherein the sintered body contains at least one oxide selected from the group consisting of niobium oxide, tantalum oxide and antimony oxide.

5. A non-linear resistance element which comprises:

(a) a sintered body principally containing titanium dioxide;

(b) at least one electrode comprising silver containing from 2 to 20% by weight of at least one auxiliary element selected from the group consisting of indium, gallium, tin, antimony, cadmium, zinc and aluminum;

(c) a layer made of a solder receptive material covering at least one part of the outer surface of the electrode.

6. A non-linear resistance element of claim 5 wherein the sintered body contains at least one oxide selected from the group consisting of niobium oxide, tantalum oxide and antimony oxide.

7. A non-linear resistance element as claimed in claim 5 wherein the solder receptive metallic material is silver of high purity.

8. A non-linear resistance element as claimed in claim 5 wherein the layer of the solder receptive metallic material is a layer of tin deposited by electrolytic plating.

* * * * *